US005639484A

United States Patent [19]

White et al.

[11] Patent Number: 5,639,484

[45] Date of Patent: Jun. 17, 1997

[54] SPINNING CELL

[75] Inventors: Patrick Arthur White, Sharnford, United Kingdom; Malcolm John Hayhurst, Coventry, England; Alan R. Owens, Nuneaton, United Kingdom; Ian David Roughsedge, Mobile, Ala.; Richard James Davies; Alan Sellars, both of South Humberside, England; Jacqueline Faye MacDonald, Bebington, United Kingdom; Michael Colin Quigley, Meriden, United Kingdom; Ralph Draper, Coventry, United Kingdom; Ronald Derek Payne, Barrow-upon-Humber, United Kingdom

[73] Assignee: Courtaulds Fibres (Holdings) Limited, London, England

[21] Appl. No.: 415,680

[22] Filed: Apr. 3, 1995

Related U.S. Application Data

[60] Continuation of Ser. No. 316,573, Sep. 30, 1994, abandoned, which is a division of Ser. No. 66,522, May 24, 1993, abandoned.

[51] Int. Cl.[6] ..... D01D 10/00

[52] U.S. Cl. ..... 425/71; 264/178 F; 264/179; 264/203; 264/211.15; 264/211.16; 425/72.2; 425/382.2; 425/464

[58] Field of Search ..... 425/71, 72.2, 66, 425/67, 68, 69, 70, 378.2, 382.2, 464; 264/178 R, 179, 178 F, 203, 211.14, 211.15, 211.16

[56] References Cited

U.S. PATENT DOCUMENTS

| | | | |
|---|---|---|---|
| 3,002,804 | 10/1961 | Kilian | 425/71 |
| 3,221,088 | 11/1965 | Martin | 425/71 |
| 3,512,214 | 5/1970 | Shiba et al. | 425/71 |
| 3,905,381 | 9/1975 | Meyer | 425/71 |
| 3,932,576 | 1/1976 | Patel | 425/71 |
| 3,996,321 | 12/1976 | Weinberger | 425/71 |
| 4,070,431 | 1/1978 | Lewis et al. | 425/71 |
| 4,193,962 | 3/1980 | Roberts | 425/71 |
| 4,728,473 | 3/1988 | Satoh et al. | 264/211.16 |
| 4,836,507 | 6/1989 | Yang | 264/211.14 |
| 5,299,926 | 4/1994 | Nakajima et al. | 425/71 |

FOREIGN PATENT DOCUMENTS 5-44104 2/1993 Japan .

*Primary Examiner*—Jay H. Woo
*Assistant Examiner*—Joseph Leyson
*Attorney, Agent, or Firm*—Fish & Richardson P.C.

[57] ABSTRACT

A spinning cell for producing lyocell fibre by spinning a solution of cellulose in an organic solvent through an air gap into a spin bath has nozzles to create a cross-draught through the air gap.

18 Claims, 6 Drawing Sheets

SPINNING CELL

This is a continuation of Ser. No. 08/316,573 filed on Sep. 30, 1994, which is a division of Ser. No. 8/066,522 filed on May 24, 1993. Both of said applications are now abandoned.

BACKGROUND OF THE INVENTION

This invention relates to spinning cells and has particular reference to spinning cells used for the coagulation of lyocell filaments.

As used herein, the term "lyocell" is defined in accordance with the definition agreed by the Bureau International pour la Standardisation de la Rayonne et de Fibres Synthetique (BISFA) namely:

"A cellulose fibre obtained by an organic solvent spinning process; it being understood that:

(1) an "organic solvent" means essentially a mixture of organic chemicals and water; and (2) "solvent spinning" means dissolving and spinning without the formation of a derivative".

Thus a lyocell fibre is produced by the direct dissolution of the cellulose in a water containing organic solvent—typically N-methyl morpholine N-oxide—without the formation of an intermediate compound. After the solution is extruded (spun) the cellulose is precipitated as a fibre. This production process is different to that of other cellulosic fibres such as viscose, in which the cellulose is first converted into an intermediate compound which is then dissolved in an inorganic "solvent". The solution in the viscose process is extruded and the intermediate compound is converted back into cellulose.

BRIEF DESCRIPTION OF THE PRIOR ART

The general process for the preparation of lyocell fibres is described and illustrated in U.S. Pat. No. 4,416,698, McCorsley, the contents of which are incorporated herein by way of reference.

The present invention is particularly concerned with the spinning cell into which the extruded fibres pass after leaving the spinnerette or jet, first passing through an air gap and then into a coagulation bath.

The solution of cellulose in the organic solvent may be, and is preferably, passed through a spinnerette as described and illustrated in our copending Application Ser. No. 08/066,779 of even date and through a jet assembly as described and illustrated in our copending Application Ser. No. 08/066,777 of even date now U.S. Pat. No. 5,527,178. The contents of each of which are incorporated herein by way of reference.

SUMMARY OF THE INVENTION

By the present invention there is provided a spinning cell for the coagulation of lyocell filaments from a dope of cellulose contained in an organic solvent for the cellulose, the cell including a spin bath for the leaching of the solvent from the filaments and an air gap above the spin bath, said air gap being defined at the lower side by the surface of said spin bath and at the upper side by a spinnerette from which said filaments emerge, wherein the improvement comprises:

(i) providing a blow nozzle having an exit on one side of said air gap, (ii) providing a suck nozzle having an entrance on the opposite side of said air gap to said blow nozzle, (iii) said suck nozzle having a greater cross-sectional area at its entrance than said blow nozzle has at its exit, (iv) baffle means located within said spin bath to restrict the flow of currents of liquid within said spin bath and to calm the surface of said liquid, (v) an aperture at the lower end of the spin bath through which coagulated filaments emerge in the form of a tow, (vi) a cylindrical gaiter of flexible resilient material having an orifice which in the unrestrained condition is slightly smaller in cross-sectional area than said tow, said gaiter being sealingly secured at its upper end around said aperture at said lower end of said spin bath, said tow passing, in use, through said orifice and thereby expanding the cross-sectional area of said orifice, (vii) means to supply spin bath liquor to said spin bath, (ix) means to remove spin bath liquor from said spin bath, (viii) means to supply air of defined temperature and humidity to said blow nozzle.

The present invention further provides an improved method of coagulating lyocell filaments from strands of a solution of cellulose in an aqueous n-methyl morpholine N-oxide solvent which includes the steps of passing said strands through an air gap into a spin bath containing a mixture of water and n-methyl morpholine N-oxide so as to leach said n-methyl morpholine N-oxide from said strands to coagulate said lyocell filaments and extracting said lyocell filaments from said spin bath, whereby the improvement comprises:

(i)providing a cross-draught of air across said air gap parallel to the surface of said mixture in said spin bath, (ii) maintaining the temperature of said air below 50° C. and above the temperature which would cause freezing of water within said strands of said mixture, (iii) maintaining the relative humidity of said air providing said cross-draught below a dew point of 10° C., (iv) damping the flow of liquid currents generated in said mixture in said spin bath by the passage of said strands and said filaments through said spin bath, (v) extracting said lyocell filaments in the form of a tow through a hole in the lower portion of said spin bath, said hole being provided with a resilient periphery to be resiliently urged into contact with said tow, and (vi) maintaining the length of the strands in the air gap in the range 0.25 to 50 cm.

The present invention further provides a method for the production of lyocell filaments, including the steps of extruding a solution of cellulose in an aqueous organic solvent through a die containing a plurality of holes to form a plurality of strands of solution, passing said strands through an air gap and into a water-containing spin bath so as to leach the solvent from the strands and form a plurality of filaments of lyocell, the improvement which comprises providing a cross-draught of air between said die and said spin bath.

The present invention further provides a method for the production of cellulose filaments from a solution of cellulose in an organic solvent, which comprises the steps of extruding said solution through a die having a plurality of holes across a gaseous gap into a water-containing spin bath, there being provided a forced flow of gas through said gap parallel to the upper surface of the water in the spin bath.

The die may have in excess of 500 holes and may have between 500 and 100,000 holes, preferably between 5,000 and 25,000 holes and further preferably between 10,000 and 25,000. The holes may have a diameter in the range 25 microns to 200 microns.

The solution of cellulose may be maintained at a temperature in the range 90° C. to 125° C.

The gas may be air and the air may be both blown and sucked across the air gap. The air gap may have a height between 0.5 cm and 25 cm. The solution may be extruded substantially vertically downward into the spin bath. The air may have a dew point of 10° C. or below and may have a temperature in the range 0° C. to 50° C.

The filaments may be extracted from a hole in the bottom of the spin bath, and the hole may be provided with a flexible gaiter to contact the filaments passing therethrough so as to reduce spin bath liquid passage through the hole.

There may be a weir surface to define the upper level of liquid in the spin bath. The weir may be defined by at least one edge of the spin bath. There may be provided a drainage passage down the side of the spin bath adjacent the weir. There may be a water trap in the drainage passage.

The spinning cell may be rectangular in shape with a blow nozzle on one longer side and the suck nozzle on the opposed longer side. There may be an access door in one or both shorter sides of the cell. The upper edge of the cell on the such side may act as a weir to define the level of liquid in the cell. There may be drainage passage on the outside of the wall having the weir. The drainage passage may include a liquid trap to prevent air being sucked up the passage.

The baffles may be provided at a plurality of levels in the cell. The baffles may comprise apertured plates.

There may be provided a thermally insulating layer beneath the side walls of the spinnerette on at least the blow side. The insulating layer may be provided on the blow side and on the two short sides.

BRIEF DESCRIPTION OF THE DRAWINGS

By way of example embodiments of the present invention will now be described with reference to the accompanying drawings of which.

DESCRIPTION OF THE INVENTION

The invention can most clearly be understood by comparisons of the drawings attached hereto with the invention described and illustrated in U.S. Pat. No. 4,416,698.

Figure 2:
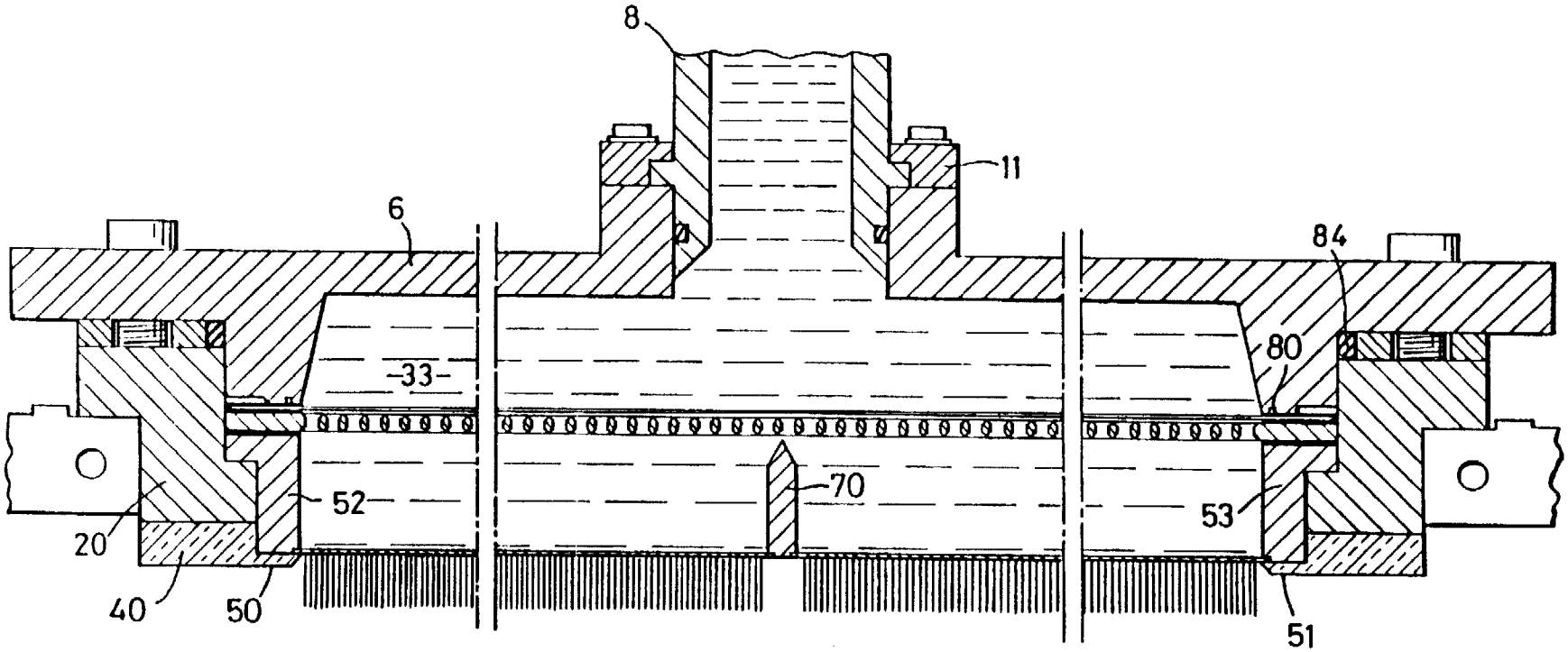
FIG. 2 is a cross section of a portion of FIG. 1 perpendicular to the section of FIG. 1.

In FIG. 2 of U.S. Pat. No. 4,416,698, it can be seen that the solution of cellulose in amine oxide and non-solvent typically water—is extruded through a jet or spinnerette 10 to form a series of filaments which pass through an air gap into a water bath. The filaments then pass around a roller 12 to emerge from the upper surface of the water bath. When the filaments emerge from the spinnerette 10 and encounter the air gap they are stretched within the air gap. When the filaments enter the liquid in the spin bath the solvent leaches out of the filaments to reform the filaments so as to produce the cellulosic filaments themselves.

The number of filaments produced by the spinnerette in the prior reference U.S. Pat. No. 4,416,698 is low—typically 32 filaments are produced, see example 1 column 6, line 40.

Although such low numbers of filaments may be suitable for the preparation of filamentary lyocell yarn, when it is required to produce staple fibre, then it is necessary to spin very large numbers of filaments simultaneously. Typically in excess of 5,000 filaments would be produced per spinning cell and a plurality of spinning cells would be arranged in a side-by-side location to produce very large numbers—in the hundreds of thousands—of filaments which could be washed and cut to form staple fibre.

The invention provides a spinning cell in which there is provided a cross-draught of air in the air gap to cool the filaments as they emerge from the spinnerette. Typically the temperature at which the cellulose solution is extruded through the spinnerette is in the range 95° to 125° C. If the temperature drops too low, the viscosity of the cellulose solution becomes so high that it is impractical to extrude it through a spinnerette. Because of the potential exothermic nature of the cellulose solution in N-methyl morpholine N-oxide (herein NMMO), it is preferred that the temperature of the solution—sometimes referred to as a dope—is maintained below 125° C., preferably below 115°–110° C. Thus the temperature of the dope in the spinnerette is close to at or above the boiling point of the water which is typically used in the spin bath. The contents of the spin bath may be water alone or a mixture of water and NMMO. Because the NMMO is continuously leached from the filaments into the spin bath, the spin bath would during normal operation always contain The provision of the cross-draught of air in the air gap has been found to stabilise the filaments as they emerge from the spinnerette, thus enabling larger numbers of filaments to be spun at a given time and enabling the simultaneous production of the large number of filaments required for the manufacture of staple fibre on a commercial scale.

The use of a cross-draught enables the gap between the face of the spinnerette and the liquor in the spin bath to be kept to a minimum level, hence reducing the overall height of the spinning cell.

For optimum performance the humidity of the air should be controlled so that it has a dew point of 10° C. or less. The dew point may be in the range 4° C. to 10° C. The temperature of the air can be in the range 5° C. to 30° C., but the air can be at 10° C. with a relative humidity of 100%.

Figure 5:
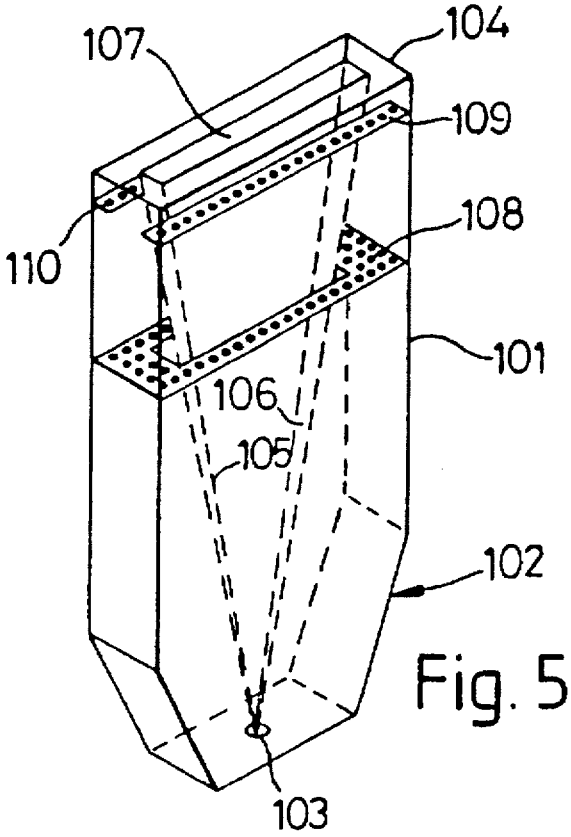
FIG. 5 is a perspective view of one form of spinning cell.

Referring to FIG. 5 this shows a spinning cell 101 which has a generally rectangular shape with a prismatic portion 102 towards the lower end. At the bottom of the cell is an outlet hole 103 which will be described in further detail below. The upper edge 104 of the spinning cell defines the upper level of liquor in the spinning cell. Typically the liquor contained in the cell would be a mixture of water and 25% NMMO, but concentrations in the range 10% to 40% or 20% to 30% weight of NMMO can be used. The dotted lines 105, 106, define the path of the filaments passing through the spin bath during the leaching process. At the upper end of the cell the filaments are in a generally rectangular array 107. The shape of the array 107 will be defined by the shape of the spinnerette or jet through which the filaments are extruded in the spinning process. To prevent excessive turbulence of spin bath liquor within the cell, perforated plates 108, 109, 110 having 3 mm holes and 40% voidage are located within the upper region of the cell to restrict flow of cell liquor within the cell.

As the filaments pass downwardly in a tow through the cell they entrain spin bath liquor held at 25° C., or in the range 20° C. to 30° C., and the entrained liquor is carried downwardly. Because the total cross sectional area of the tow of filaments is reduced as they approach the outlet, excess spin bath liquor is expressed sideways from the tow of filaments. This sets up a pumping action of liquor within the bath, tending to produce currents of liquor in the cell. The use of the porous baffles 108, 109 and 110 significantly reduces turbulence of the surface of the spin bath and within the upper portion of the bath. This reduction in turbulence prevents or significantly reduces splashing of the spin bath liquor up on to the face of the spinnerette and disruptive movement of the filaments.

Figure 6:
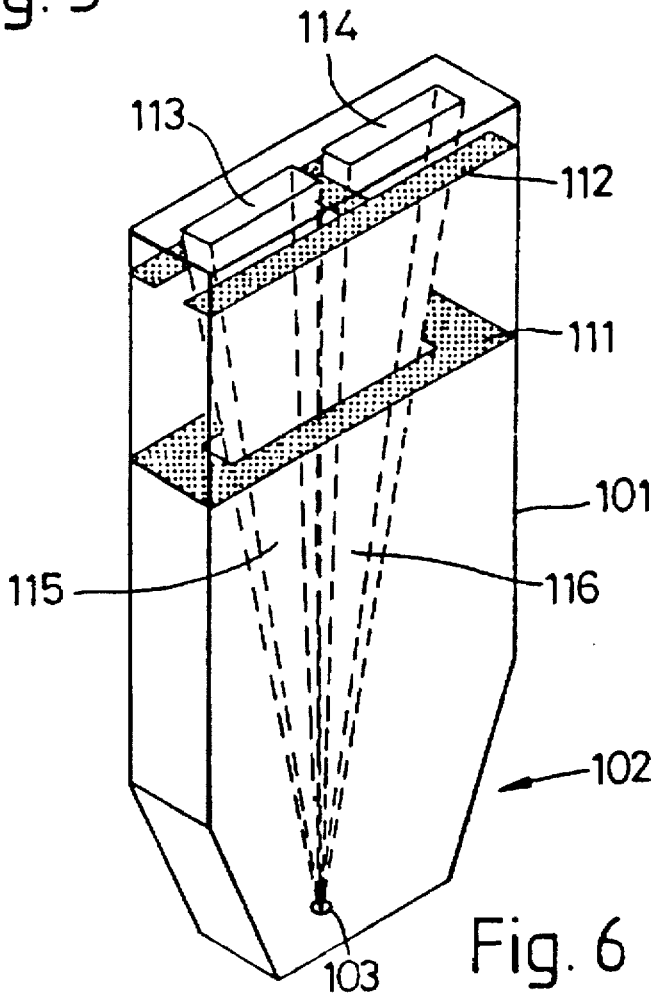
FIG. 6 is a perspective view of a second form of spinning cell.

As shown in FIG. 6, the baffles 111 and 112 are preferably shaped so as to be quite close to the moving surfaces of the tow or tows of filaments passing downwardly through the cell. In the case of the use of a spinnerette which forms the filaments into two rectangular tows 113, 114 these pass downwardly through the spinning cell as conical regions 115, 116 until they combine to emerge through the hole 103 at the bottom of the spinning cell.

Figure 7:
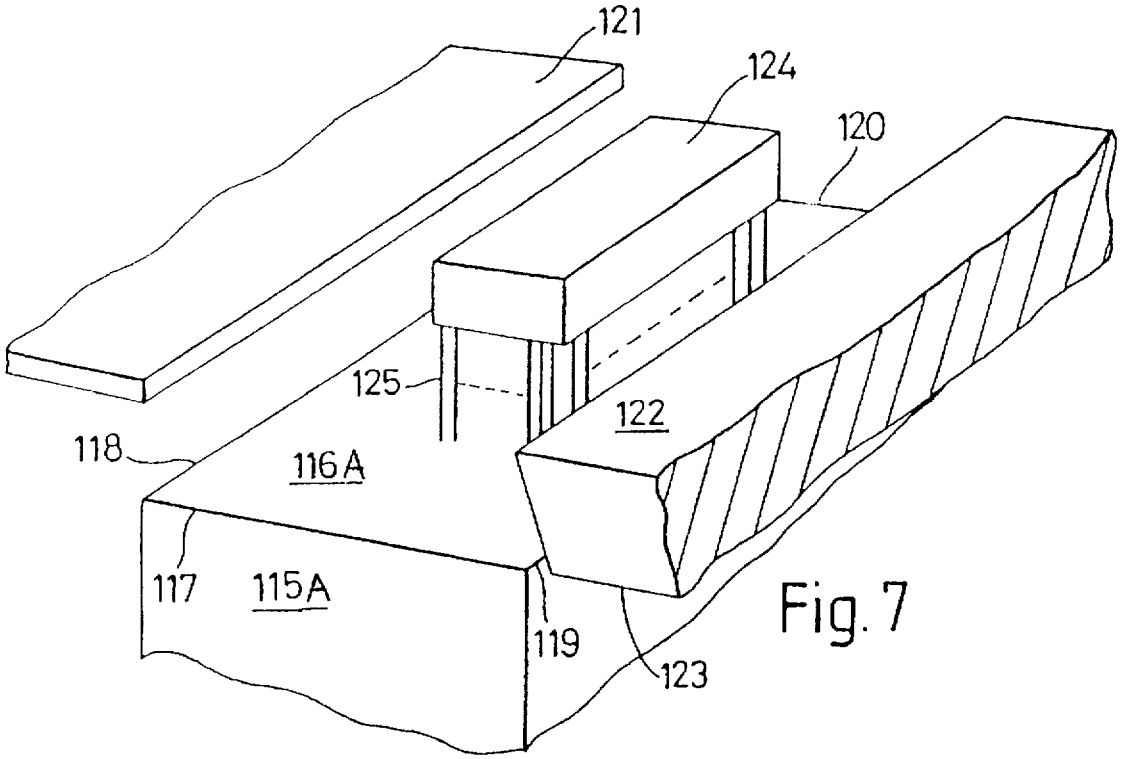
FIG. 7 is a perspective view of the upper portion of the spinning cell of FIG. 6 showing the air gap.

Referring to FIG. 7, this shows in more detail the air gap and the cross-draught arrangement. The spin bath 115A which has an upper surface 116A defined by the edges 117, 118, 119 and 120 of the spinning cell. Effectively the edges act as dams or weirs and a slight excess of spin bath liquor is passed into the cell to flow over the weirs so as to form a surface 116A of constant location and therefore of fixed height.

A cross-draught in the form of air having a temperature in the range 10° C. to 40° C. and a relative humidity in the range of dew points 4° C. to 10° C. is blown across the air gap from a blow nozzle 121 into a suction nozzle 122. Air is sucked through the nozzle 122 so as to maintain a parallel flow of air across the spin bath. The thickness of the blow nozzle 121 is about one quarter to one fifth of the thickness of the suction nozzle 122. The lower edge 123 of the suction nozzle 122 is substantially at the same level as the edge 119 of the spin bath. The edge 123 may be slightly below the level of the spin bath edge 119. Air typically at 20° C. is blown at 10 metres/second across the air gap.

Typically the blow nozzle 121 would have a thickness of about 25 mm and the air gap would then be about 18 to 20 mm.

The jet assembly 124 which produces the filaments 125 is preferably of the type described and illustrated in our copending Application Ser. No. 08/066,777 referred to above and incorporates spinnerettes of the type described and illustrated in our copending Application Ser. No. 08/066,779 referred to above. In those two specifications, there are described spinnerettes formed of thin sheets of stainless steel welded into a structure which has a flat under surface mounted in an assembly which provides heat to the spinnerette and which insulates the bottom of the spinnerette. Such spinnerettes are ideally suited to the spinning cell of the present invention in that the cross-draught of air has been found to stabilise the filaments emerging from the spinnerette.

Figure 1:
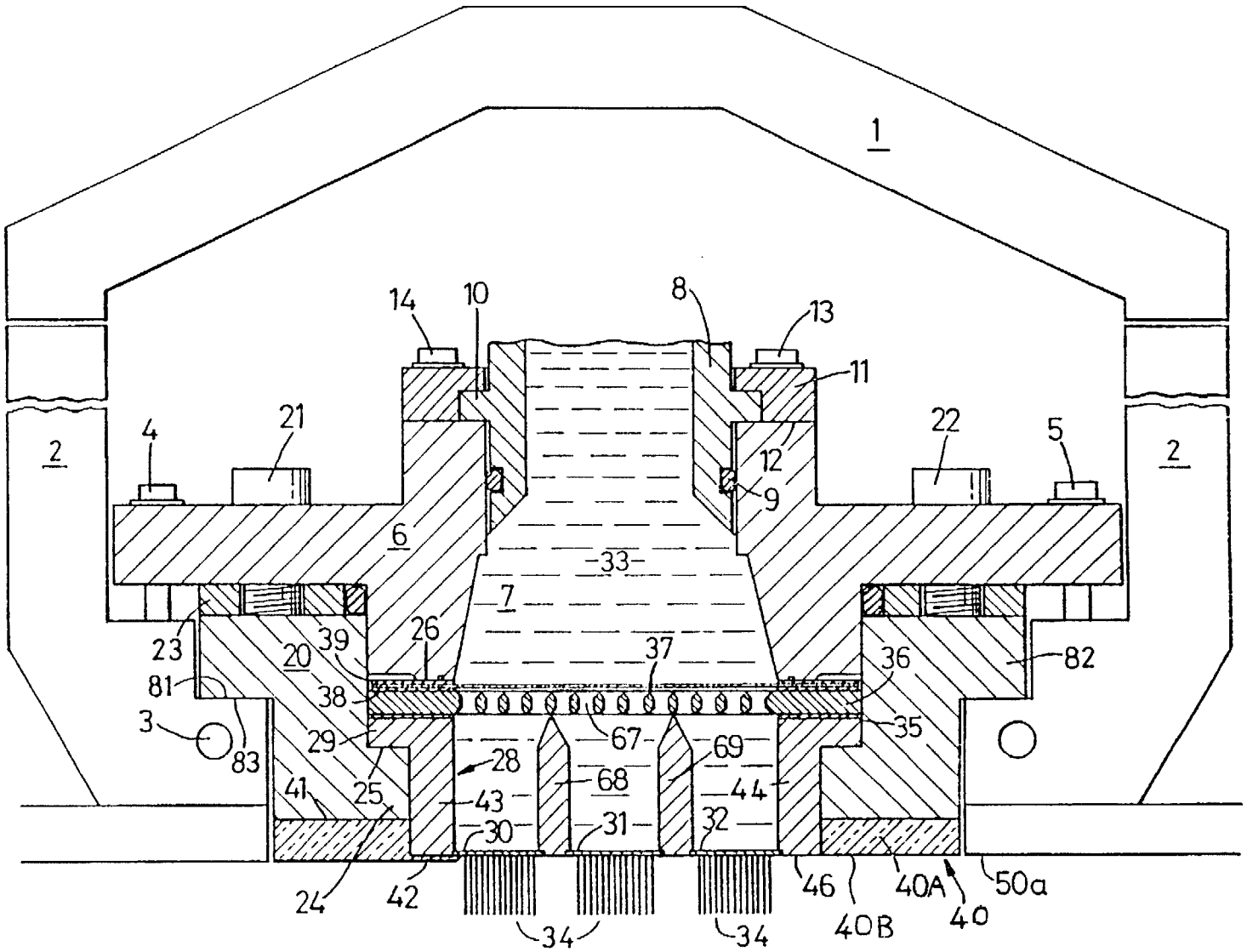
FIG. 1 is a cross sectional view along a minor axis of a jet assembly.

Referring to FIG. 1, this shows a jet assembly located within an insulating cover 1 and frame 2. The frame 2 is thermally insulated from its steel support structure, and has a bore 3 extending around the frame through which a suitable heating medium such as hot water, steam, or oil, can be passed to heat the lower end of the frame. Because the cellulose solution spun through the jet assembly is supplied to the jet assembly at an elevated temperature, typically 105° C., it is preferable to provide heating to maintain the solution at the correct temperature and to provide insulation to minimise excessive heat loss and to prevent injury to operating personnel.

Bolted to the frame 2 by means of bolts or studs 4, 5 is a top housing 6. The top housing forms an upper distribution chamber 7 into which is directed an inlet feed pipe 8. The inlet feedpipe is provided with an O-ring seal 9 and a flange 10. A locking ring 11 is bolted to the upper face 12 of the top housing 6 to trap the flange 10 to hold the inlet feedpipe on the top housing. Suitable bolts or studs 13, 14 are provided to bolt the ring 11 to the top housing 6.

Bolted to the underside of the top housing 6 is a bottom housing 20. A series of bolts 21, 22 are used to bolt the top and bottom housing together and an annular spacer 23 forms a positive stop to locate the top and bottom housings together at a predefined distance.

The bottom housing 20 has an inwardly directing flange portion 24 which has an annular upwardly directed surface 25. The upper housing 6 has an annular downwardly directing horizontal clamping face 26.

Clamped between the faces 25 and 26 is a spinnerette, a breaker plate and filter assembly. The spinnerette, shown in perspective view in FIG. 3, essentially comprises a rectangular member in plan view, having a top hat cross section and comprising an upwardly directed peripheral wall generally indicated by 28 incorporating an integral outwardly directed flange portion 29. The spinnerette incorporates a plurality of aperture plates 30, 31, 32 which contain the holes through which the solution of cellulose in amine oxide, 33 is spun or extruded to form the filaments 34.

The spinnerette construction is more clearly shown and illustrated in our co-pending Patent Application Ser. No. 08/066,779 filed on May 24, 1993, the contents of which are incorporated herein by way of reference.

Located on the upper surface of the flange 29 is a gasket 35. Located on top of the gasket 35 is a breaker plate 36 which essentially comprises an apertured plate used to support a filter element 37. The filter element 37 is formed of sintered metal, and if the sintered metal has a fine pore size, the pressure drop across the filter can, in use, rupture the filter. The breaker plate 36, therefore, supports the filter in use. A pair of gaskets 38, 39 on either side of the filter completes the assembly located between the upwardly directed face 25 of the bottom housing and the downwardly directed face 26 of the top housing. By clamping the assembly together with the bolts 21, 22, the spinnerette, breaker plate and filter are held positively in position.

Located beneath the bottom housing 20 is an annular insulating ring 40 which is generally rectangular in plan shape. The annular insulating ring extends around the complete periphery of the wall 28, which wall 28 extends below the lower face 41 of the bottom housing 20. On one long side of the spinnerette, there is provided an integral extension portion 42 of the insulating ring 40 which extends below the long wall portion 43 of the peripheral wall 28. On the other long wall portion 44 of the peripheral wall 28 the insulating ring 40 does not have the integral extension portion 42, but the lower face 40B of the portion 40A of the ring 40 is in the same plane as the face 46 of the portion 44 of the peripheral wall 28 of the spinnerette.

As is more easily seen in FIG. 2, the insulating ring 40 which is secured to the underside of the bottom housing 20 by screws (not shown) has the integral extension portions 50, 51 extending over the lower faces of the portions 52, 53 of the shorter lengths of the peripheral wall 28 of the spinnerette.

Figure 3:
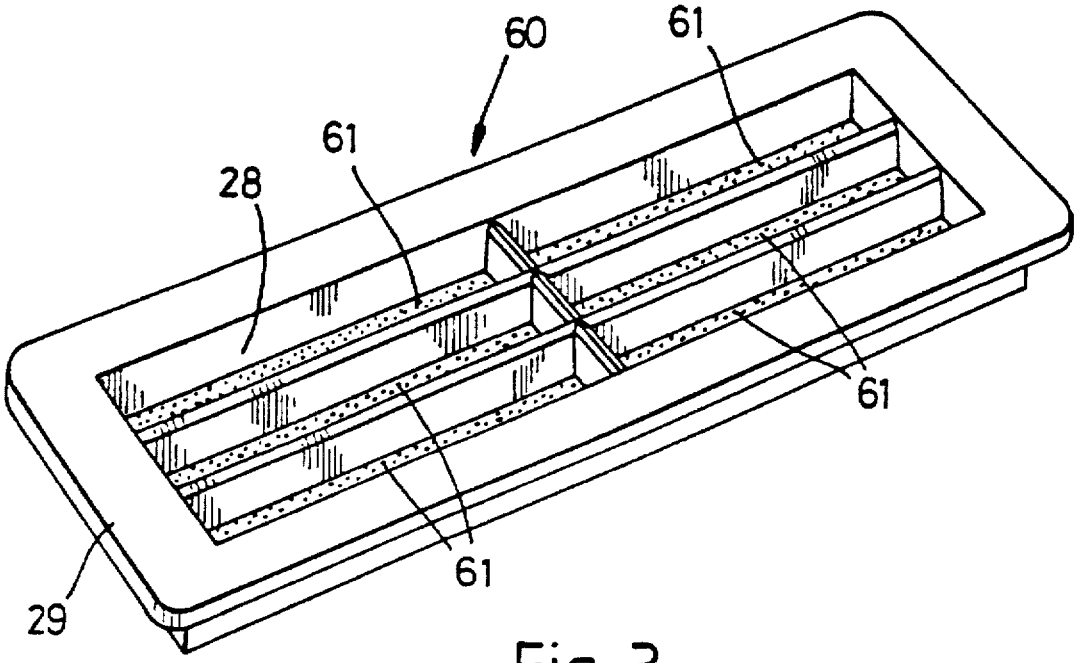
FIG. 3 is a perspective view of a spinnerette.

Referring to FIG. 3 this shows in perspective the spinnerette incorporated into the jet assembly. The spinnerette, generally 60, has an outer flange 29 integral with the wall 28. The rectangular nature of the spinnerette can clearly be seen from the perspective view in FIG. 3. The minor axis of the spinnerette is shown in the sectional view of FIG. 1 and the major axis is shown in sectional view in FIG. 2. Welded into the bottom of the spinnerette are six aperture plates of which three of the plates 30, 31, 32 are seen in sectional view figure of FIG. 1. These plates contain the actual holes through which the cellulose solution is extruded. The holes can have a diameter in the range 25μ to 200μ and be spaced by 0.5 to 3 mm in a centre-to-centre measurement. The spinnerette has an underside in a single plane and is capable of withstanding the high extrusion pressures experienced in spinning a hot cellulose solution in amine oxide. Each plate can contain between 500 and 10,000 holes, i.e. up to 40,000 holes for jets with four plates. Up to 100,000 holes can be used.

Figure 4:
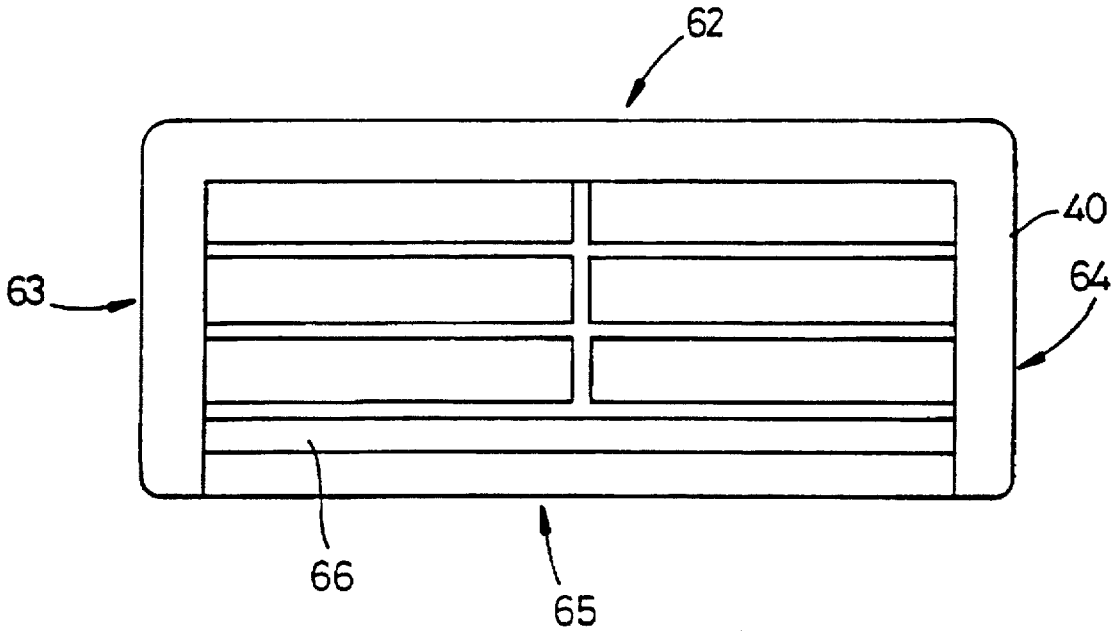
FIG. 4 is an underneath plan view of the spinnerette and insulation.

FIG. 4, is an underneath view of the spinnerette showing the location of the insulating annular member 40. It can be seen that the insulating layer, typically formed of a resin impregnated fabric material such as TUFNOL (trade mark) extends below the lower portion of the peripheral wall 28 on three sides of the spinnerette. Thus, seen from below, on sides 62, 63 and 64, the lower portion of the wall 28 is obscured by the extension portions in the insulating layer shown as 42, 50*a* and 51 in FIGS. 1 and 2. However, on the fourth side, side 65, the lower portion 66 of the wall 28 of the spinnerette 60 is not insulated and is, therefore exposed. The insulating annulus, therefore, is effectively surrounding the spinnerette completely and extends on three sides beneath the peripheral wall of the wall of the spinnerette.

It will be noted that the breaker plate 36 has tapered holes 67 which enhance the flow of viscous cellulose solution through the jet assembly whilst providing a good support for the filter 37. In turn the breaker plate 36 is supported by the upper edges of the internal bracing members or spars 68, 69, 70. The upper edges of the internal bracing members or spars may be displaced from the centre line of the members or spars so that the entrance area above each aperture plate is equal.

The facings 25, 26 of the housing and/or the breaker plate 36 may be provided with small recesses such as recess 80 so as to permit the gasket to be extruded into the recess to enhance sealing when the bolts holding the top and the bottom housing together are tightened. An O-ring 84 may be provided between the top and bottom housing to act as a second seal in the event of failure of the main seals between the top and bottom housing and the breaker plate and filter assembly.

The jet assembly of the invention is, therefore, capable of handling highly viscous high pressure cellulose solution in which typically the pressure of the solution upstream of the filter may be in the range 50 to 200 bar and the pressure at the jet face may be in the range 20 to 100 bar. The filter itself contributes to a significant amount of pressure drop through the system whilst in operation.

The assembly of the invention also provides a suitable heat path whereby the temperature of the dope in the jet can be maintained close to the ideal temperature for spinning for extrusion purposes. The bottom housing 20 is in firm positive contact with the spinnerette through its annular upwardly directed face 25. The bolts or set screws 22 ensure a firm positive contact. Similarly, the bolts 4,5 positively ensure that the bottom housing 20 is held tightly to the frame member 22 via its downwardly directed face 81 on an outwardly directed flange portion 82. The face 81 is in positive contact with the upwardly directed face 83 of the housing 2.

By providing a heating element in the form of a heating tube 3 directly below the face 83 there is a direct flow path for heat from the heating medium in the bore 3 into the spinnerette. It can be seen that heat can flow through the faces 83, 81 which, as mentioned above, are held into positive contact by set screws 4, 5. Heat can then flow through the bottom housing 20 via the face 25 and flange 29 into the spinnerette wall 28.

It will readily be appreciated that assemblies of the type illustrated in the drawings of the present application are normally assembled in an ambient temperature workshop. Thus typically the top and bottom housing, the spinnerette, the breaker plate and filter plate assembly will be bolted up at ambient temperature by bolting down the screws 21, 22. To enable the spinnerette to be inserted into the bottom housing 20 there needs to be a sufficient gap between the peripheral wall 28 and the interior hole of the bottom housing 20 which permits the spinnerette to be inserted and removed. It will also be appreciated that in use the assembly is heated to typically 100° C. The combination of heating and internal pressure means that there will be an unregulated expansion of the assembly. All of this means that it is not possible to rely upon a direct heat transfer sideways from the lower portion of the bottom housing directly horizontally into the side of the peripheral wall 28.

Similar constraints apply to the direct horizontal transfer into the outer side wall of the bottom housing 20 directly from the heated lower portion of the frame 2. However, by providing for a positive clamped face-to-face surface such as surface 81, 83, a positive route for the transfer of heat from the medium within bore 3 to the spinnerette is provided. Any suitable heating medium such as hot water, steam or heated oil can be passed through the bore 3.

The provision of the lower insulation 40 whilst not needed from a safety to personnel view point ensures that the heat from the hot cellulose solution itself is passed into the jet assembly from the bore 3 and does not escape through the lower face of the bottom housing.

It will readily be appreciated that the components of the jet assembly should be manufactured from material capable of withstanding any solvent solution passed through it. Thus, for example, the jet may be made from stainless steel and the housings may be made from stainless steel or castings of cast iron as appropriate. The gaskets may be formed of PTFE.

Without prejudice to the present invention it is believed that the cross-draught tends to evaporate some of the water contained in the cellulose NMMO water solution so as to form a skin on the filaments as they emerge from the spinnerette. The combination of the cooling effect of the cross-draught and the evaporation of moisture from the filaments cools the filaments, thus forming a skin which stabilises the filaments prior to their entry into the spin bath. This means that very large numbers of filaments can be produced at a single time.

Figure 8:
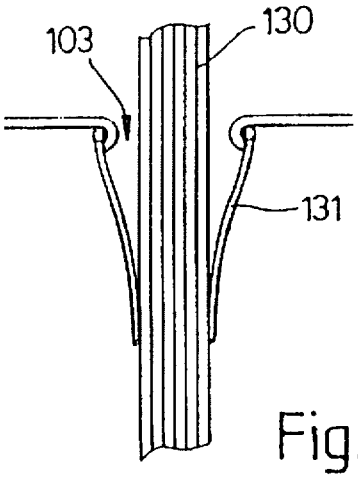
FIG. 8 is a cross-sectional view of the exit from the spinning cell.

At the bottom end of the spinning cell, the holes 103 are each provided with gaiters as is illustrated in more detail in FIG. 8. The tow 130 of filaments passes through the hole 103 into a resilient gaiter 131 which is located at its upper end in firm and liquid type contact with the wall of the hole 103. A gaiter 131 has an aperture at its lower end slightly smaller in diameter than the tow 130. The gaiter is formed of neoprene rubber and the tow 130 stretches the rubber slightly so as to form a form contact with the tow as it passes through the gaiter.

This restricts the excess flow of liquor out of the bottom of the spinning cell. The tow subsequently passes underneath a godet and then upwardly for washing and further processing. Below the godet there may be provided a drip tray to catch spin bath liquor entrained in the tow and passing through the gaitered hole.

Figure 9:
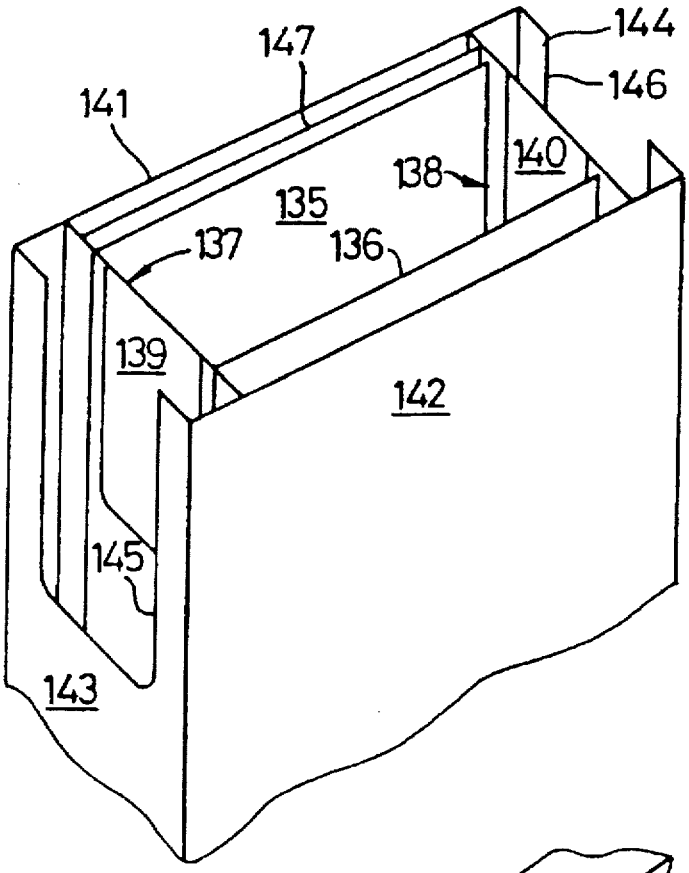
FIG. 9 is a perspective view of the top of a spin bath.
Figure 10:
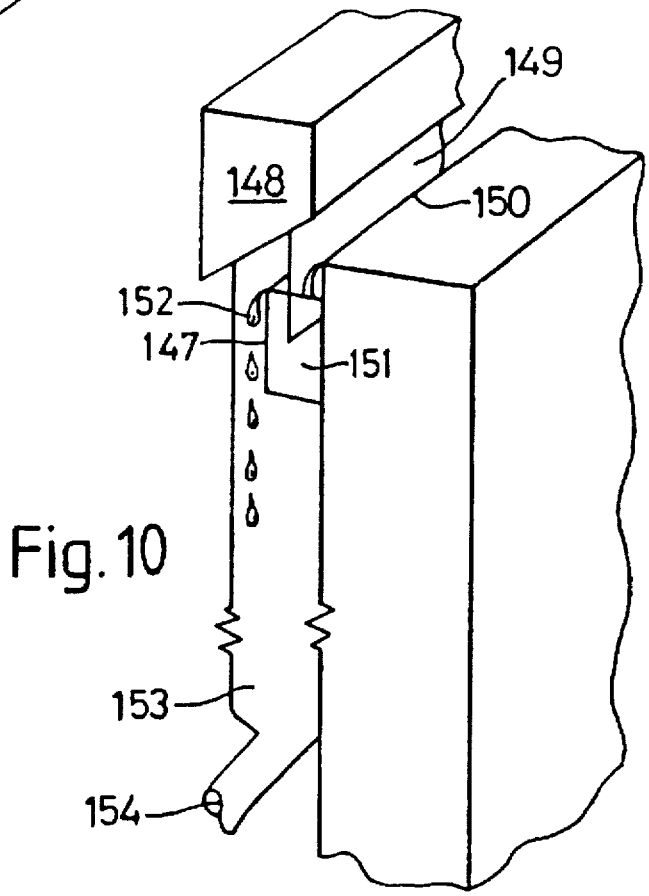
FIG. 10 is a cross-sectional view of a water trap.

The liquor flow in the upper portion of the spinning cell is described more clearly with reference to FIGS. 9 and 10. FIG. 9 shows a perspective plan view of an empty upper portion of a spinning cell. The spinning cell effectively comprises a liquid tight vessel defined by side walls 135, 136 and end walls 137 and 138. The side walls 135 and 136 are continuous steel side walls, whereas the end walls 137 and 138 are provided with doors 139, 140 as described more fully below.

Outside of the liquid tight spinning cell defined by the walls 135 to 138, there is an external framework defined by side walls 141, 142 and end walls 143, 144. It can be seen that the end walls 143 and 144 are provided with U-shaped cut outs generally indicated by 145, 146. The upper edges of the walls 135, 136 are slightly below the upper edges of the side walls in particular that portion of the side walls defined by doors 139, 140. The doors may be formed of metal or may be formed of glass or clear plastic. The doors are mounted in the side walls so that they may be conveniently opened. The doors may, for example, be hinged at their lower edges and held in position by means of side bolts or the doors may be bolted around three sides to the side walls of the cell.

In use, a slight excess of liquid is pumped into the spinning cell and the excess liquid overflows the upper sides of the edges 135 and 136 to form an upper surface of liquid in the cell. If desired the upper edges may be serrated.

On the suck side of the cell, there is preferably provided a liquid trap. This is shown more clearly in FIG. 10 but it essentially comprises a channel formed between an angled wall 147 and the upper portion of the side wall 135. The suck nozzle 148 has a dependent strip 149 which extends below the upper surface of the channel 147. Excess liquid then flows over the upper edge 150 into the channel 151 to fill the channel and overflow as at 152 into a gutter 153. Excess liquid flows out of pipe 154 to be recycled as required. The effect of the combination of the liquid in the channel 151 together with the dependent strip 149 is to form a gas tight seal to prevent the suction nozzle 148 sucking air up along the side of the cell between the walls 141 and 135.

By providing the hole at the bottom of the spin bath cell as is described above, the initial lacing up of the tow to commence preparation of the production of lyocell fibres is considerably eased. The process for commencing production, therefore, simply comprises spinning a small quantity of fibres into the cell and then hooking the fibres through the hole in the bottom to pull the tow downwardly around the lower godet or roller (not described) and then thread the tow onwardly through the fibre washing and drying section.

Because of the narrow gap between the upper end of the spinning cell and the lower regions of the jet assembly, lacing up of the tow is considerably eased by the provisions of the doors 139 and 140. To lace up the cell at the commencement of spinning operation, the doors 139 and 140 are opened—the liquor from the cell then falling into the surrounding catchment troughs. The spinning is then commenced and the spun fibres can be manipulated and pushed through the hole at the bottom of the cell. Once the cell has been laced up, the door 139, 140 can be closed, the cell refilled and operation can then be continued automatically.

If required, plain water can be used in the spin bath for starting purposes. This water tends to froth less than water amine oxide mixtures and eases start up of the cell. The provision of the doors 139, 140 also enables ready access to the interior of the spin bath and to the edges of the suck nozzle. This enables small quantities of crystalline growth which appear on the cell during operation to be removed. It is believed that these crystalline growths arise from the slight evaporation of amine oxide.

It will be appreciated that a large number of cells may be aligned in a side-by-side relationship and the bottom of each cell can readily be accessed by an operator. If on the other hand the fibres emerge through the upper surface of the spin bath, the lacing up of the system is very much more complicated and involve an operator trying to work below the surface of the spin bath to collected the fibres in tow firm below the surface of the spin bath. Additionally, when large numbers of cells are placed in side-by-side relationship it becomes difficult to access the top of the cells particularly if the air gap is very small and the cells are narrow. It can be seen that utilising the lower outlet the cells can be narrow and little larger than the wedge of tow passing through the spin bath.

We claim:

1. In a spinning cell for the coagulation of lyocell filaments from a dope of cellulose contained in an organic solvent for the cellulose, the cell including a spin bath having a lower end and containing an aqueous liquid for the leaching of the solvent from the filaments, said liquid exhibiting an upper surface, and an air gap above the spin bath, said air gap being delimited below by the upper surface of said liquid in said spin bath and above by a spinnerette from which said filaments emerge, the improvement which comprises:

(i) a blow nozzle having an exit on one side of said air gap, (ii) a suck nozzle having an entrance on the opposite side of said air gap from said blow nozzle, (iii) said suck nozzle having a greater cross-sectional area at its entrance than said blow nozzle has at its exit, (iv) baffle means located within said spin bath to restrict the flow of currents of said liquid within said spin bath and to calm said upper surface of said liquid, (v) an aperture at the lower end of the spin bath through which coagulated filaments pass in the form of a tow, (vi) a cylindrical gaiter of flexible resilient material having an upper end and an orifice which, in an unstrained condition of the gaiter, is slightly smaller in cross-sectional area than said tow, said gaiter being sealingly secured at its upper end around said aperture at said lower end of said spin bath, said tow passing, in use, through said orifice and thereby expanding the cross-sectional area of said orifice, (vii) means to supply spin bath liquid to said spin bath, (viii) means to remove spin bath liquid from said spin bath, and (ix) means to supply air of defined temperature and humidity to said blow nozzle.

2. A spinning cell as claimed in claim 1 in which the cell is rectangular in shape with the blow nozzle on one longer side and the suck nozzle on the opposed longer side.

3. A spinning cell as claimed in claim 2 in which there is an access door in at least one shorter side of the cell.

4. A spinning cell as claimed in claim 3 in which the upper edge of the cell on the suck side acts as a weir to define the level of liquid in the spin bath.

5. A spinning cell as claimed in claim 4, in which there is a drainage passage down the outside of the spin bath adjacent the weir.

6. A spinning cell as claimed in claim 5 in which the drainage passage includes a liquid trap to prevent air being sucked up the passage.

7. A spinning cell as claimed in claim 1 in which the baffle means are provided at a plurality of levels in the spin bath.

8. A spinning cell as claimed in claim 7 in which the baffle means comprise apertured plates.

9. A spinning cell as claimed in claim 1, in which the spinnerette has side walls, there being a thermally insulating layer beneath the side wall on at least the side of the spinnerette adjacent the blow nozzle.

10. A spinning cell for the coagulation of cellulose filaments formed from a solution of cellulose in an organic solvent, the cell having a spin bath containing liquid for the leaching of the solvent from a tow of the filaments, the spin bath having a lower end providing a hole through which the tow can pass out of the spin bath, the hole being provided with a resilient gaiter to provide a resilient periphery to resiliently contact the tow, the gaiter having a lower end providing an orifice slightly smaller in diameter than the tow, whereby said contact between the gaiter and the tow is at said lower end to retain liquid in the spin bath.

11. A spinning cell according to claim 10, which is positioned so that a gap is provided above the spin bath and is defined between an upper surface of liquid in the spin bath and a lower surface of a die through which the filaments emerge.

12. A spinning cell according to claim 11, which includes means to provide a forced flow of gas through the gap parallel to the upper surface of the liquid in the spin bath.

13. A spinning cell for the coagulation of cellulose filaments formed from a solution of cellulose in an organic solvent, the cell comprising a spin bath containing liquid for the leaching of solvent from a tow of the filaments as the tow moves through the spin bath, the spin bath having a lower end providing an outlet for the tow, means to move the tow through the spin bath and through the outlet of the spin bath, means to reduce the cross-sectional area of the tow as it travels towards the outlet, and baffles positioned at a plurality of levels in the spin bath, the baffles being shaped to be close to the moving tow passing towards the outlet, whereby turbulence within the liquid in the bath is reduced by the baffles.

14. A spinning cell according to claim 13, in which the baffles are porous.

15. A spinning cell according to claim 13, in which the baffles are perforated plates.

16. A spinning cell according to claim 13, in which the baffles are positioned within an upper region of the spin bath.

17. A spinning cell according to claim 13, in which a gap is provided above the spin bath and is defined between an upper surface of liquid in the spin bath and a die surface through which the filaments emerge.

18. A spinning cell according to claim 17, which includes means to provide a flow of gas through the gap parallel to the upper surface of the liquid in the spin bath.

* * * * *

UNITED STATES PATENT AND TRADEMARK OFFICE

CERTIFICATE OF CORRECTION

PATENT NO. : 5,639,484

DATED : June 17, 1997

INVENTOR(S) : White et al.

It is certified that error appears in the above-indentified patent and that said Letters Patent is hereby corrected as shown below:

Col. 4, line 38, insert --NMMO.-- after "contain".

Signed and Sealed this

Sixteenth Day of September, 1997

*Attest:*

Bruce Lehman

BRUCE LEHMAN

*Attesting Officer*

*Commissioner of Patents and Trademarks*